United States Patent [19]

Sato et al.

[11] 4,221,327

[45] Sep. 9, 1980

[54] MINIATURE COUNTER HAVING ZERO RESET PUSH BUTTONS

[75] Inventors: Susumu Sato, Tokyo; Koji Hamada, Yokohama, both of Japan

[73] Assignee: Tamura Electric Works, Ltd., Tokyo, Japan

[21] Appl. No.: 972,724

[22] Filed: Dec. 26, 1978

[51] Int. Cl.[2] ..... G06C 15/42

[52] U.S. Cl. ..... 235/144 HC; 235/144 SS; 235/144 SM

[58] Field of Search ..... 235/144 HC, 144 SS, 235/144 EA, 144 B, 144 SM, 144 R, 117 R

[56] References Cited

U.S. PATENT DOCUMENTS

| | | | |
|---|---|---|---|
| 3,003,692 | 10/1961 | Heuer | 235/144 SS |
| 3,053,441 | 9/1962 | Vroom | 235/144 HC |
| 3,053,441 | 9/1970 | Howard | 235/144 HC |
| 3,286,916 | 11/1966 | Stolarz | 235/1 D |
| 3,588,476 | 6/1971 | Lapointe | 235/117 R |
| 3,725,648 | 4/1973 | Schmick et al. | 235/92 C |
| 3,963,903 | 6/1976 | Pirro et al. | 235/144 R |
| 3,977,599 | 8/1976 | Bud et al. | 235/144 HC |
| 4,096,377 | 6/1978 | Prentice et al. | 235/144 HC |

*Primary Examiner*—L. T. Hix
*Assistant Examiner*—Benjamin R. Fuller
*Attorney, Agent, or Firm*—Claude A. S. Hamrick

[57] ABSTRACT

A counter comprising a U-shaped frame, a plurality of digit wheels each having a heart-shaped cam, pinions respectively located between adjacent digit wheels for shifting the digit, a zero resetting bracket which supports the pinions and including a plurality of press members for pressing the heart-shaped cams, a reset button for operating the zero resetting bracket to disengage the digit wheels from the pinions and to press the heart-shaped cams with the press members thereby resetting the digit wheels to zero and drive means for driving the digit wheel. A plurality of slots are provided in the frame at positions beneath respective digit wheels for receiving respective heart-shaped cam push members. A cover including a magnifying lens for reading the numerical data displayed by the digit wheels is mounted on the frame to cover the digit wheels. The reset button is supported by the cover.

7 Claims, 11 Drawing Figures

MINIATURE COUNTER HAVING ZERO RESET PUSH BUTTONS

BACKGROUND OF THE INVENTION

1. Field of the Invention

This invention relates to a miniature counter reset to zero by a push button, and more particularly to a miniature counter especially suitable to be utilized in combination with a tape recorder or similar device.

2. Description of the Prior Art

The push button zero reset type counter is well known in the art and is frequently incorporated into various devices for controlling and displaying numberical data generated by the devices. It is desirable to miniaturize the counter as the size of the devices incorporated with the counter becomes smaller. Various constructions and configurations of counters have been proposed to meet this requirement. However, since prior art counters are not completely satisfactory in all applications, it has become desirable to provide a compact counter with a protective cover which is capable of providing performance equivalent to larger scale prior art counters and which displays information which even though small in size can easily be read.

U.S. Pat. No. 3,963,903, for example, discloses a counter comprising a counter frame disposed above a group of digit wheels, a numerical data read unit mounted on the frame, and a cover. This counter is not of the push button reset type and the characters are small and difficult to read.

Another prior art counter is disclosed in U.S. Pat. No. 3,286,916. This counter is also not of the push button reset type and has lenses for magnifying the displayed characters formed on the inner surface of a cover at positions corresponding to the positions on the digit wheels to be displayed.

An electromagnetic counter similar to these is disclosed in U.S. Pat. No. 3,725,648, in which a convex lens is integrally formed into the surface of the cover. The covers disclosed in U.S. Pat. Nos. 3,963,903 and 3,286,916 merely comprise glass plates fitted in the front ends of cylindrical casings which are independent of the counter frame. This configuration limits miniaturization. However, in the electromagnetic counter disclosed in U.S. Pat. No. 3,725,648, the cover is constructed to also act as a casing for the counter. Since the flange of the cover is secured to the base by screws, it is impossible to significantly miniaturize the construction.

It is also desirable to provide a push button zero reset type counter in which the combination of digit wheels can be altered to change the display position. With the prior art counters previously discussed, it is necessary to change the design to meet this goal. One method which has been tried is the push button zero reset type counter disclosed in Japanese Utility Model Publication No. 5070 of 1972. In this counter, pinions or press members which are invisible from the read position are operated, in conjunction with heart-shaped cams placed rigidly on the same shaft as the digit wheels, to rotate the digit wheels. However, if the pinions or press members are disposed along one side of the digit wheels the press members would extend between the bottom plates of the frame at positions below the digit wheels. With this construction, it is necessary to provide sufficient space between the digit wheels and the bottom frame plates to assure proper operation of the press members as they engage the heart-shaped cams. The dimensions of this space are determined by the space necessary to ensure positive engagement between the end of each press member and its respective heart-shaped cam until a digit wheel disengages a pinion, the difference between the levels of the high point and the low point of the heart-shaped cam, and the height of the press member. However, the idle space and the difference in the levels constitute a dead space which does not contain any component element of the counter, thus hindering the miniaturization of the counter.

SUMMARY OF THE PRESENT INVENTION

Accordingly, it is an object of this invention to provide an improved miniaturized counter which may be reset to zero by a push button.

Another object of this invention is to provide a push button zero reset type counter wherein the vertical dimension has been minimized by eliminating the dead space between the digit wheels and the bottom plate of the counter frame found in prior art counters.

Still another object of this invention is to provide a push button zero reset type counter the size of which is reduced by using extremely small digit wheels with a magnifying lens such that the displayed digits are easily readable. The lens is formed integrally with the cover the counter and the cover is constructed such that it can readily be incorporated into a miniaturized frame without necessitating any other component parts.

A further object of this invention is to provide an improved push button zero reset type counter in which the reset push button is supported by the assembled frame and cover of the counter.

Still another object of this invention is to provide a push button zero reset type counter wherein the read position of the digit wheels may be altered by changing the manner in which the cover is mounted on the frame.

Yet another object of this invention is to provide a miniature push button zero reset type counter which eliminates an idler gear mechanism by directly linking the drive shaft with the pinions utilized to shift the digits of the digit wheel.

According to this invention these and further objects can be accomplished by providing a miniature counter which can be reset to zero by a push botton and which includes a substantially U-shaped frame having a bottom plate and a pair of parallel side plates at the opposite ends of the bottom plate, the bottom plate being provided with a plurality of centrally located slots extending parallel to the side plates and an upright projection positioned in spaced-apart relationship near one of the side plates, each of the side plates being provided with two pairs of shaft openings and a recess on the inner plate surface for defining shoulders spaced from the shaft openings; a digit wheel shaft with opposite ends thereof securely fitted into corresponding shaft openings in the side plates; a plurality of digit wheels rotatably mounted on the digit wheel shaft, each digit wheel being provided with a gear on one side, a heart-shaped cam on the opposite side and a digit shift pin gear around a portion of the perimeter of the digit wheel; a zero resetting bracket member having a shaft with its opposite ends securely fitted in the other pair of shaft openings, said zero resetting bracket member including a base provided with an aperture through which the shaft loosely extends, a pair of opposed parallel supports at each end of the base, each support being provided with a pair of shaft openings, and a plurality of heart-shaped cam press members having free ends extending beneath the respective digit wheels, the heart-shaped cam press members being of the same number as the digit wheels and extending in parallel with the side plates; a pinion shaft extending through opposing openings in the supports of zero resetting bracket member, the opposite ends of the pinion shaft extending beyond the supports and abutting against the shoulders defined by the recesses in the side plates to determine the distance between the axes of the digit wheel shaft and the pinion shaft; a plurality of pinions rotatably mounted on the pinion shaft, each pinion being positioned between adjacent ones of the digit wheels to mesh with the gear of a digit wheel having a higher order of magnitude and to lock the digit wheel having a lower order of magnitude, the pinion being driven by the digit shift pin gear when the pinion completes one revolution for stepping the digit wheel having the higher order of magnitude; a reset button positioned between one of the side walls and the upright projection of the bottom plate to be slidable parallel with the side plates, the reset button being provided with an operating member adapted to engage one end of the pinion shaft at a point beyond the support of the zero resetting bracket member; drive means for rotating the digit wheel representing the lowest order of magnitude; the heart-shaped cam press members of the zero resetting bracket member being received in the slots of the bottom plate under normal conditions whereby when the reset button is depressed, its operating member presses the projected end of the pinion shaft so as to rotate the zero resetting bracket in such a manner that the press members are disengaged from the digit wheels and from the slots such that the press members press the corresponding heart-shaped cams and thereby reset the digit wheels to zero.

An advantage of the presnet invention is that it provides an improved push button zero reset type counter which may be maximally miniaturized due to its lack of idle space.

A further advantage of the present invention is that the magnification of the integrally formed lens in the cover member can be selected to allow for exceedingly small digit wheels.

These and other objects and advantages of the present invention will no doubt become apparent from the following detailed description of the preferred embodiment which is illustrated in the several figures of the drawing.

IN THE DRAWING

DETAILED DESCRIPTION OF THE PREFERRED EMBODIMENT

Figure 1:
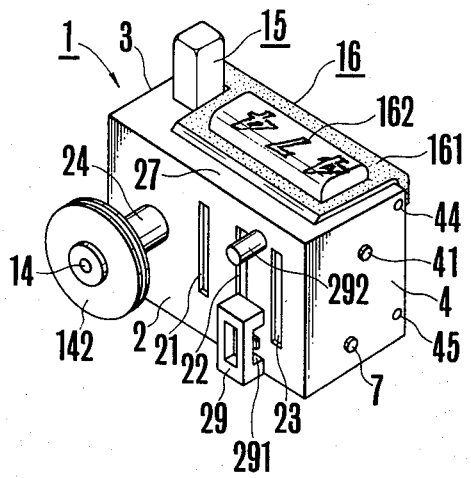
FIG. 1 is a perspective view showing the top, front and left side of a preferred embodiment of a miniature push button zero reset type counter in accordance with the present invention.
Figure 3:
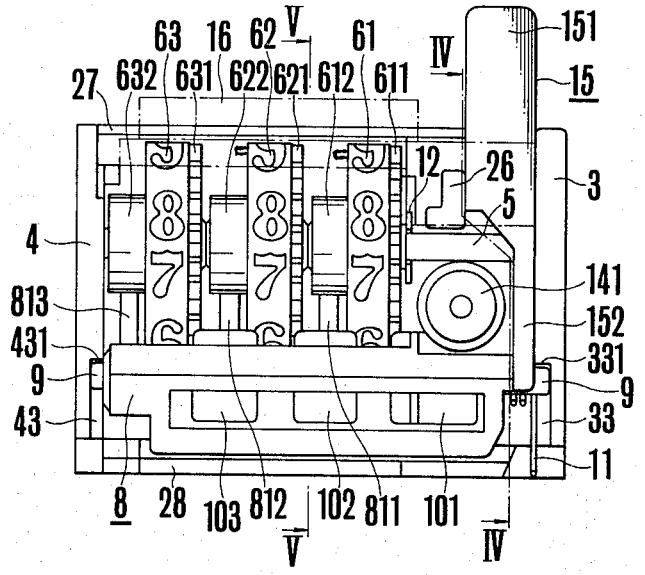
FIG. 3 is a plan view of the counter shown in FIG. 1, with the cover removed.
Figure 2:
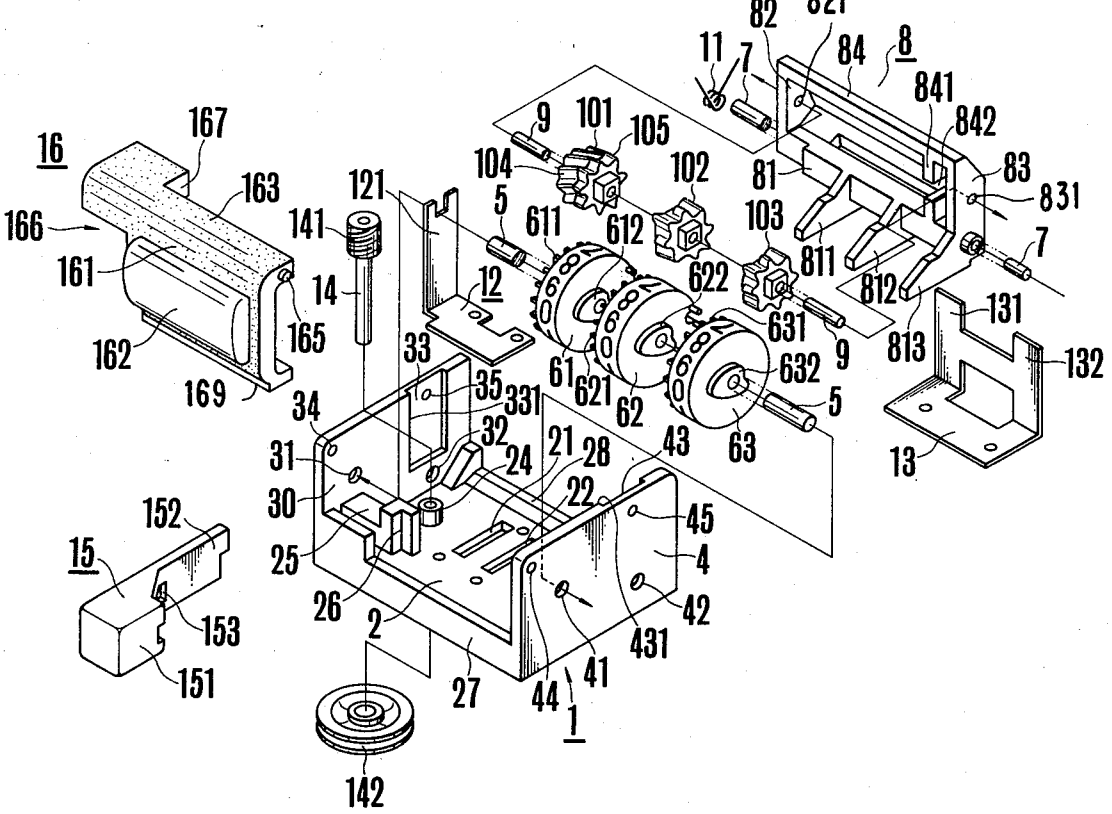
FIG. 2 is an exploded perspective view of the counter shown in FIG. 1.

Referring now to FIG. 1, a preferred embodiment of a miniature push button zero reset type counter is shown. The counter is designed to be incorporated into a tape recorder for integrating and displaying the quantity of tape which has passed the measurement position on the device and thereby provides measures and benchmarks for recording or reproduction. The terms "front", "rear", "upper" and "lower" used in the following description are used to represent the directions as viewed in FIG. 2, with "front" corresponding to the top (lens and push button) surface of FIG. 1, and "bottom" corresponding to the front (wheel) surface shown in FIG. 1. However, in actual front read usage of the counter, it is necessary that the up and down directions be inverted such that the digits will appear to be right-side up and the lowest magnitude digits will appear on the right. Thus, in usage the lens portion will be the front and the zero reset button will be situated to the right of the lens. For convenience of description, the references are inverted as stated to maintain the U-shaped member as being a "base" and also to fit the alternate embodiment of the counter wherein the cover is rotated and the read or display position is from the orientation of FIG. 3. In this alternate embodiment, the directional references used throughout are accurate as stated and the display position will be at the top of the counter while the reset button will extend to the front.

FIG. 1 illustrates the assembled counter in the orientation in which it might appear in a top loading tape device. The protective cover and magnifying reading lens appear on the upper surface whereas in the more common application of a front loading device this surface will be the front, thus making the zero reset push button motion horizontal, rather than vertical as shown here. The data input enters the counter by way of the wheel and shaft shown. In a front loading application, this wheel would be at the bottom of the counter so as to most effectively interact with the tape drive mechanism.

A molded synthetic resin counter frame 1, generally in the form of a U with its front, rear and upper sides opened, provides the support base for the components. More particularly, a pair of parallel upright side plates 3 and 4 are integrally formed on both sides of a rectangular bottom plate 2 having a relatively large thickness. Centered in the bottom plate 2 are three elongated slots 21, 22 and 23 (not shown), arranged parallel to the side plates 3 and 4. A bearing 24 is provided on the bottom plate 2 near the left side plate 3. A projection 25 including a flat upper surface and a vertical extension 26 which is parallel with left side wall 3 is situated in front of the bearing 24. The upper surface of the projection 25 is flat, and re-enforcing vertical walls 27 and 28 are provided at the front and rear edges of the bottom plate 2. The portion of the front wall 27 adjacent the side plate 3 has substantially the same height as that of the upper edge of the projection 25. Extending below the bottom plate 2 is a rectangular projection 29 (see FIG. 1) having rectangular apertures 291 on both sides. A dowel 292 is situated on bottom plate 2 in front of the projection 29 (above the projection as viewed in FIG. 1). The rectangular projection 29 and the dowel 292 are used to mount the counter on a tape recorder.

Side plates 3 and 4 are each provided with shaft openings 31, 41 and 32, 42. Recesses 33 and 43 are formed on the inner surfaces of side plates 3 and 4 above shaft openings 32 and 42, respectively, to form shoulders 331 and 431 at predetermined distances from the other shaft openings 31 and 41, respectively. Furthermore, small perforations 34, 44, 35 and 45 are formed near the upper edges of the side plates 3 and 4.

The opposite ends of the shafts 5 of the digit wheels are journalled in the shaft openings 31 and 41 of the side plates 2 and 3. A plurality of digit wheels 61, 62 and 63 are rotatably mounted on the shaft 5. Digits 0 through 9 are formed on the perimeter of each digit wheel and the digit wheels are provided with pin gears 611, 621 and 631 on the sides thereof facing the side plate 3. Heart-shaped cams 612, 622 and 632 are provided on the sides facing the side plate 4. The cams are mounted such that their high points correspond to digits "0" on the respective digit wheels whereas their low points correspond to the digit 5. Although not clearly shown in the drawing a pair of digit shift pin gears are provided at the perimeter of the side surfaces of the digit wheels 61 and 62 on which the heart-shaped cams 612 and 622 are formed.

Figure 5:
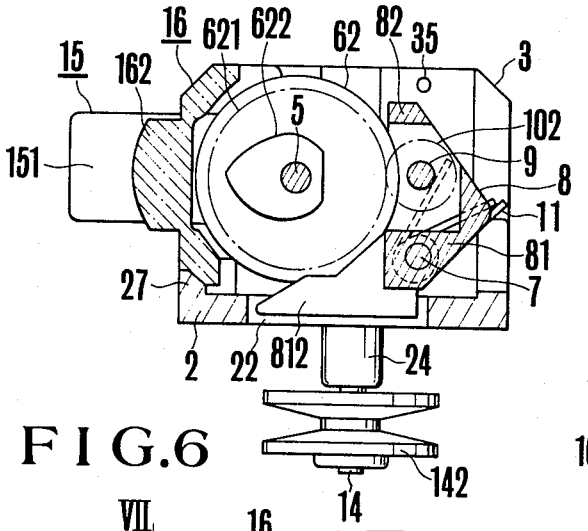
FIG. 5 is a cross-sectional view taken along line V—V of FIG. 3.

The opposite ends of the shaft 7 of a zero resetting bracket 8 rotatably mounted thereon are securely received in the other shaft openings 32 and 42 of the side plates 3 and 4 of the frame. The zero resetting bracket 8 comprises a base 81 having an opening for loosely receiving shaft 7, a pair of upright supports 82 and 83 on the opposite ends of the base 81 and extending in parallel with the side plates 3 and 4, and a connecting member 84 interconnecting the upper ends of the supports 82 and 83. Heart-shaped cam press pieces 811, 812 and 813 are formed on the lower surface of the base 81 and extend in parallel with the side plates 3 and 4 toward the lower side of respective heart-shaped cams 612, 622 and 623 of the digit wheels 61, 62 and 63, respectively. As shown in FIG. 5, these press pieces 811, 812 and 813 are normally received in slots 21, 22 and 23, respectively, of the bottom plate 2. Openings 821 and 831 are formed near the upper ends of the supports 82 and 83 and a pinion shaft 9 extends through these openings with its opposite ends projected beyond the supports 82 and 83. A re-enforcing wall 841 is provided near the support 83 for interconnecting the base 81, and the connecting member 84 is formed with a U-shaped groove 842 for guiding the pinion shaft 9.

Pinions 101, 102 and 103, each having a square boss, are rotatably mounted on the pinion shaft 9. Pinion 101 is disposed to be engageable with a driving device, to be described later, and the pinion gear of the digit wheel 61. The pinion 102 is disposed between the digit wheels 61 and 62 to be engageable with the pinion gear 621 of the digit wheel 62, whereas the pinion 103 is disposed between the digit wheels 62 and 63 to be engageable with the pinion gear 631 of the digit wheel 63. The pinion 101 has a special tooth shape, as will be described later along with the driving device with reference to FIGS. 9, 10 and 11. Pinions 102 and 103 have a construction similar to conventional pinions and each is provided with alternate wide and narrow teeth. Thus, under normal conditions, a pair of adjacent wide teeth functions to lock the periphery of a digit wheel having a lower order of magnitude and when this light wheel rotates one revolution it is rotated a definite angle by its shift pin gear so as to stepwise rotate a digit wheel having a higher order of magnitude.

The digit gears 61, 62 and 63 are held in engagement with pinions 101, 102 and 103, respectively, by a coil spring 11 interposed between the side plate 3 and the zero resetting bracket 8, and surrounding the shaft 7. More particularly, one end of the coil spring 11 is secured to a portion of the pinion shaft 7 so as to urge the bracket 8 in the counterclockwise direction, as viewed in FIG. 2, whereby the opposite ends of the pinion shaft 7 are urged to engage the shoulders 331 and 431 to maintain at a definite value the distance between the axes of the pinion shaft 7 and the digit wheel shaft 5. A resilient side play limiting plate 12 is secured to the upper surface of the bottom plate 2 near the side plate 3. The resilient plate 12 has an upright leg 121 in parallel with the side plate 3 and at right angles with the digit wheel shaft 5. The upright leg 121 engages the side surface of the digit wheel 61 to urge it toward the side plate 4 so as to limit the side play of the digit wheel group mounted on the shaft 5.

A pinion aligning plate 13 is secured to the rear side of the bottom plate 2. The purpose of the aligning plate 13 is to align the pinion group so that it assumes a definite attitude when these pinions are disengaged from the digit wheels at the time of the zero resetting operation to be described later. The aligning plate 13 is made of a spring plate and is provided with upright portions 131 and 132 which extend behind the frame and between adjacent pinions 101, 102 and 103. The portions are aligned with the square bosses of pinions 102 and 103.

The drive device comprises a driving shaft 14 extending through the bearing 24 of the bottom plate 2. On the upper end of the driving shaft 141 integral worm 141 is formed, while a pulley 142 is mounted on the lower end of the driving shaft 14 at a position beneath the bottom plate 2. A belt connected to the source of drive of a tape of a tape recorder, not shown, passes around the pulley to supply a driving force to the counter as the tape runs. It is to be noted that the position of the bearing 24 on the bottom plate 2 should be selected such that the pitch circles of worm 141 and of the pin gear 611 of the digit wheel lie on the same circle.

Figure 10:
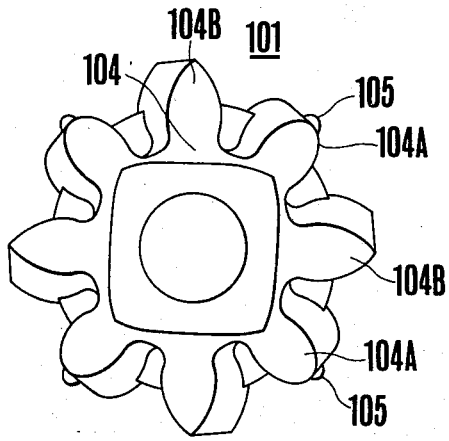
FIG. 10 is a side veiw of a pinion.
Figure 11:
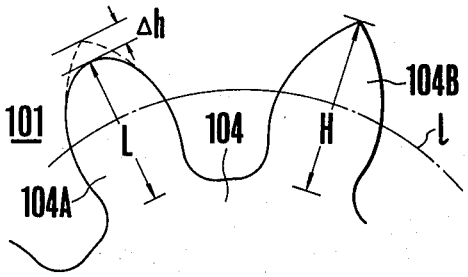
FIG. 11 is an enlarged view of a portion of a pinion.

The construction of the pinion 101 is shown in FIGS. 10 and 11. More particularly, the pinion 101 comprises a helical gear 104 adapted to mesh with the worm 141, and a spur gear 105 adapted to mesh with the pin gear 611. As shown in FIG. 11, one of the adjacent teeth of the helical gear 104 is rounded as at 104A whereas the other is pointed as at 104B. As shown by dotted lines in FIG. 11, the rounded tooth 104A is formed by grinding off the point tip of the pointed tooth. In other words, the height H of the pointed tooth 104B is larger by $\Delta h$ than the height L of the rounded tooth 104A, but their pitch circles l are the same. The rounded teeth 104A are formed to correspond to the respective corners or apexes of the square boss while the pointed teeth 104B correspond to the flat sides of the square boss. Between the inner front surface of the side plate 3 and the upright wall 26 of the projection 25 of the bottom plate 2 is disposed a reset button 15 which is slidable in the fore and aft directions of the frame. The width of the front portion 151 of the reset button 15 is made to be equal to the gap between the side plate 3 and the upright wall 26 of the projection 25 so as to act as an operating member, while the rear end 152 projects beyond the support 82 of the zero reset bracket 8 to engage one end of the pinion shaft 9 as it bears against the shoulder 331 defined by the recess 33 of the side plate 3. A rectangular groove 153 is provided in one side surface of the reset button 15 to receive and provide clearance for the digit wheel shaft 5.

Figure 6:
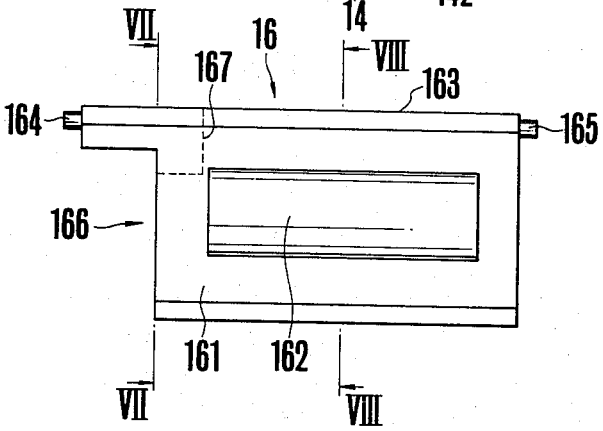
FIG. 6 is a front elevational view of the counter cover.
Figure 7:
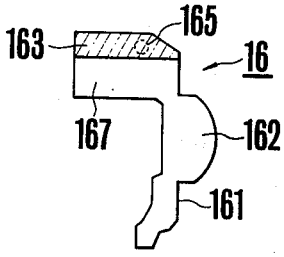
FIG. 7 is a cross-sectional view of the cover taken along line VII—VII of FIG. 6.
Figure 8:
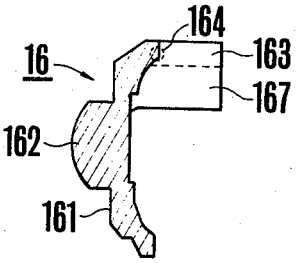
FIG. 8 is a cross-sectional view of the cover taken along line VIII—VIII of FIG. 6.

A cover 16 shown in FIGS. 6, 7 and 8 is fitted into the front opening of the frame 1. The cover is made of a transparent synthetic resin, and a digit reader 162 in the form of a convex lens which functions to selectively enlarge and display the digits of the digit wheels 61, 62 and 63 is formed on the surface 161 of the cover 16. The other portions of the surface 161 are colored black to conceal the interior of the counter. The longitudinal dimension of the cover 16 is made substantially equal to the distance between the side plates 3 and 4, and a connecting flange 163 opposing the bottom plate 2 is formed at the upper edge of the surface 161. Dowels 164 and 165 are integrally formed on both ends of the flange 163 to correspond to the small openings 34 and 44 respectively of the side plates 3 and 4. Accordingly, the cover 16 can be attached to the frame 1 by positioning the edge 169 behind wall 27 and then snapping the dowels 164 (FIG. 8) and 165 into the small openings 34 and 44.

An elongated rectangular notch 166 is formed on one side of the surface 161 of the cover 16 facing the side plate 3, and as shown by dotted lines in FIG. 6 (see also FIG. 8), a support wall 167 is formed on the inner surface of the cover 16 to extend in parallel with the side plate 3; the support wall 167 forming an inverted L-shaped member together with the connecting member 163. Accordingly, when the cover 16 is attached to the counter frame 1, a square cylindrical space is defined by the side plate 3, projection 25, its upright wall 26, cover connecting member 163 and support wall 167, and the space accommodates the operating member 151 of the reset button 15.

Figure 4:
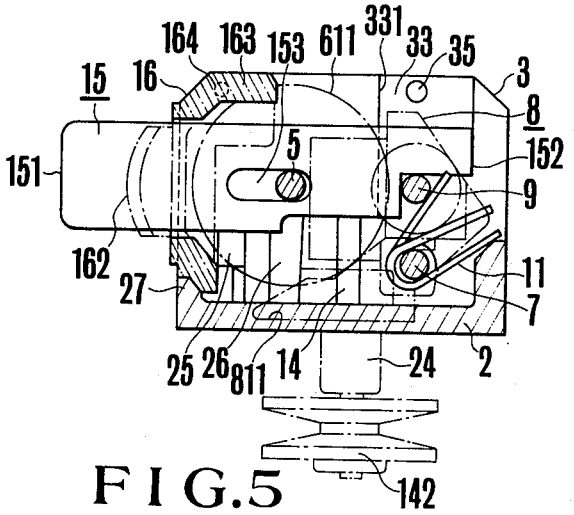
FIG. 4 is a cross-sectional view taken along line IV—IV FIG. 3.
Figure 9:
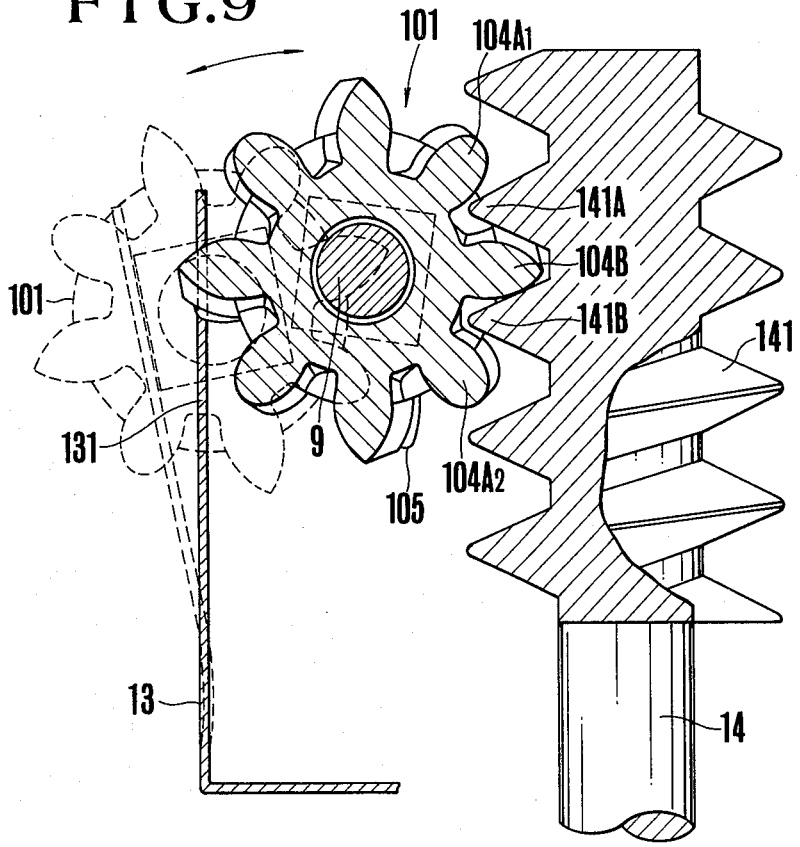
FIG. 9 is a side view, partly in section, showing the meshed interaction of a pinion and worm according to the present invention.

With the construction described above, the press pieces 811, 812 and 813 of the zero resetting bracket 8 are received in the slots 21, 22 and 23 respectively of the bottom plate 2. In other words, although the press pieces 811, 812 and 813 extend beneath the heart-shaped cams 612, 622 and 632 of the respective digit wheels 61, 62 and 63, it is possible to make the gaps between the digit wheels 61, 62 and 63 and the bottom plate 2 extremely small thereby making it possible to reduce the height of the counter. When the reset button 15 is pushed, it can slide rearwardly along the side plate 3, the support wall 167 of the counter cover 16, the upper edge of the projection 25 of the bottom plate 2, and the side surface of the upright wall 26. By this rearward movement, the operating member 152 of the reset button 15 pushes rearwardly the pinion shaft 9 which is supported by the support 82 and 83 so as to rotate the zero resetting bracket 8 in the clockwise direction as viewed in FIG. 4 against the force of spring 11. Consequently, the pin gears 611, 621 and 631 of the digit wheels 61, 62 and 63 are caused to disengage the pinions 101, 102 and 103 respectively, while at the same time the press pieces 811, 812 and 813 are caused to disengage the slots 21, 22 and 23, and engage and press the heart-shaped cams 612, 622 and 632 respectively. The pressing operation of the cam press pieces 811, 812 and 813 is continued until the low points of the cams 612, 622 and 632 are reached. Under these conditions, the respective digit wheels 61, 62 and 63 are reset to zero. The bosses of the pinions 101, 102 and 103 which are disengaged from the pinion gears 611, 621 and 631 of the digit wheels 61, 62 and 63 respectively, abut against the upright members 131 and 132 of the pinion aligning plate 13 and are thereby aligned. This condition is shown in FIG. 9.

Thus, the upright member 131 of the pinion aligning plate 13 engages the square boss of the pinion 101 so as to forcibly rotate it until its flat side is reached, and this state is maintained until the zero resetting operation of the digit wheels is completed. Since the pinion 101 is constructed as above described, the pointed tooth 104B of its helical gear 104 is positioned between the teeth 141A and 141B of the worm 141. Since the pitch of the rounded tooth $104A_1$ or $104A_2$ adjacent the pointed tooth 104B is larger than that of the tooth 141A and 141B of the worm, the outer edges of the teeth 141A and 141B do not collide against the outer edges of the pointed teeth 104B, 104A or 104B and $104A_2$. Where the counter of this invention is combined with a tape recorder as above described, the zero reset may be performed during the running of the tape so that the advantage of this invention can be manifested where the pitch of the teeth 141A and 141B varies frequently during the rotation of the worm wheel 141.

Although in the foregoing embodiment counter is constructed such that the numerical data displayed by the digit wheels 61, 62 and 63 are read from the front side of the frame 1, it is also possible to read the numerical values from above by mounting a modified cover on the upper side of the frame. For this purpose the dowels projecting from the side surfaces of the cover are fitted into openings 34, 44 or 35, 45 of the side plates 3 and 4.

Although the invention has been shown and described in terms of a specific embodiment thereof, it should be understood that many changes and modifications will be obvious to one skilled in the art.

What is claimed is:

1. A miniature counter resettable to zero by a pushbutton comprising:

a substantailly U-shaped frame having a bottom plate and a pair of parallel upright side plates at opposite ends of the bottom plate, said bottom plate being provided with a plurality of centrally located slots extending parallel to said side plates and an upright projection near one of said side plates and spaced therefrom, each of said side plates being provided with a pair of shaft openings and a recess on the inner surface for defining shoulders spaced from said shaft openings;

a digit wheel shaft with opposite ends thereof securely fitted in one of said shaft openings in each side plate;

a plurality of digit wheels rotatably mounted on said digit wheel shaft, each digit wheel being provided with a gear on one side, a heart-shaped cam on the opposite side, and a digit shift pin gear around a portion of the perimeter of the digit wheel;

a zero resetting bracket member including a shaft, the opposite ends of which are securely fitted into the other shaft openings in said side plates, said zero resetting bracket member including a base provided with a bore through which said shaft loosely extends, a pair of opposed parallel supports at both ends of said base, each said support being provided with a shaft opening, and a plurality of cam press members having free ends extending beneath said respective digit wheels, said press members being of the same number as said digit wheels and said press members extending parallel to said side plates;

a pinion shaft extending through the shaft openings in the supports of said zero resetting bracket member, the ends of said pinion shaft extending beyond said supports to abut against said shoulders defined by said recess of said side plates so as to determine a minimum distance between the axes of said digit wheel shaft and of said pinion shaft;

a plurality of pinions rotatably mounted on said pinion shaft, each pinion being positioned adjacent one of said digit wheels so as to drivably mesh with the gear thereof, the pinion corresponding to the digit wheel of the second and subsequent orders of magnitude being drivably engaged by the digit shift pin gear of the digit wheel of the next lower order of magnitude such that when the last mentioned digit wheel completes one revolution, it steps the digit wheel having the next higher order of magnitude;

a reset button positioned between one of said side plates and said projection of said bottom plate so as to be slidable parallel to said side plates, said reset button being provided with an operating member adapted to engage an end of said pinion shaft at a point where it projects beyond the support of said zero resetting bracket member;

drive means for driving the digit wheel representing the lowest order of magnitude;

said press members of said zero resetting bracket member being respectively received in said slots of said bottom plate under normal conditions, whereby when said reset button is depressed, its operating member presses the projected end of said pinion shaft causing said zero resetting bracket member to rotate and disengage said pinions from said digit wheels and to withdraw said press members from said slots of said base plate such that said press members operatively engage their corresponding heart-shaped cams and thereby reset the digit wheels to zero.

2. A miniature counter according to claim 1 and further comprising a cover which is mounted between said side plates and above said digit wheels, said cover being made of a transparent synthetic resinous material and being provided with a window portion through which said numerical data displayed by said digit wheels may be read, and having a notch into which the operating member of said reset button projects, and wherein said reset button is supported by one of said side plates, the projection of said bottom plate, and said cover plate.

3. A miniature counter reset to zero by a push button comprising:

a substantially U-shaped frame having a bottom plate and a pair of parallel upstanding side plates at opposite ends thereof, each one of said side plates being provided with a pair of shaft openings and a recess on the inner surface thereof for defining a shoulder spaced from one of said shaft openings;

a digit wheel shaft having its ends securely fitted into one of said shaft openings in each side plate;

a plurality of digit wheels rotatably mounted on said digit wheel shaft, each said digit wheel being provided with a gear on one side, a heart-shaped cam on the opposite side, and a digit shift pin gear disposed on the perimeter of the digit wheel;

a zero resetting bracket member including a shaft with its opposite ends securely fitted into the other shaft openings in each said side plate, a base provided with a bore through which said shaft loosely extends, a pair of opposed parallel supports at the ends of said base, each said support being provided with a shaft opening, and a plurality of press members extending parallel to said side plates and having free ends respectively extending beneath said digit wheels, the number of said press members being of the same as that of said digit wheels;

a pinion shaft extending through the shaft opening in the supports of said zero resetting bracket member such that the ends thereof abut against said shoulders defined by said recesses of said side plates and thereby determine the distance between the axes of said digit wheel and said pinion shaft;

a plurality of pinions rotatably mounted on said pinion shaft, each said pinion being positioned between adjacent digit wheels so as to mesh with gear of the digit wheel representing the higher order of magnitude, each said pinion being driven one step by the digit shaft pin gear of he lower magnitude digit wheel when it completes one revolution;

a reset button positioned between one of said side plates and said projection of said bottom plate so as to be slidable parallel to said side plates, said reset button being provided with an operating member adapted to engage an end of said pinion shaft at a point where said shaft projects beyond the support of said zero resetting bracket member;

drive means for driving the digit wheel representing the lowest order of magnitude;

a cover mounted between said side plates and above said digit wheels, said cover being made of a transparent synthetic resin and having a numerical digit read section in the form of a lens which magnifies the numerical data displayed on the perimeter surfaces of said digit wheels, the portions of said cover other than said lens being opaque so as to conceal the interior of said counter.

4. A miniature counter according to claims 1 or 3 wherein one or more small openings are formed near the upper edges of said side plates and dowel pins corresponding to said small openings are formed on both side edges of said cover whereby said cover is mounted on said frame by engaging said dowel pins with said corresponding small openings.

5. A miniature counter according to claims 1 or 3 wherein one or more small openings are formed near the upper and side edges of said side plates, and dowel pins corresponding to said small openings are formed on both side edges of said cover whereby said cover is mounted on said the upper side or lateral side of said frame by engaging said dowel pins with said corresponding small openings.

6. A miniature counter according to claims 1 or 3 wherein said drive means comprises a bearing sleeve mounted at substantially the center of one side of said bottom plate, a drive shaft rotatably supported by said bearing sleeve and driven by an external drive source, and a worm formed at one end of said drive shaft to mesh with the pinion engaged with the gear of said digit wheel representing the lowest order of magnitude.

7. A miniature counter according to claim 6 wherein said pinion includes a helical gear meshing said worm and a spur gear meshing the gear of said digit wheel representing the lowest order of magnitude, said helical gear including teeth of an even number with alternating teeth being pointed and the remaining teeth being rounded, and wherein said counter further comprises pinion aligning means so that when said counter is reset by said reset button, said pinions are aligned by said aligning means so that one of said pointed teeth engages said worm upon release of the reset button.

* * * * *